US009592542B2

(12) United States Patent
James et al.

(10) Patent No.: US 9,592,542 B2
(45) Date of Patent: Mar. 14, 2017

(54) METHOD AND APPARATUS FOR CLEANING THE INTERIOR OF AN ABOVE GROUND STORAGE TANK

(71) Applicants: Michael Henry James, Maringouin, LA (US); Michael William O'Rourke, Port Allen, LA (US)

(72) Inventors: Michael Henry James, Maringouin, LA (US); Michael William O'Rourke, Port Allen, LA (US)

( * ) Notice: Subject to any disclaimer, the term of this patent is extended or adjusted under 35 U.S.C. 154(b) by 183 days.

(21) Appl. No.: 14/293,804

(22) Filed: Jun. 2, 2014

(65) Prior Publication Data

US 2014/0261548 A1 Sep. 18, 2014

Related U.S. Application Data

(63) Continuation-in-part of application No. 13/456,746, filed on Apr. 26, 2012, now abandoned.

(51) Int. Cl.
*B08B 9/093* (2006.01)
*B08B 9/08* (2006.01)
(Continued)

(52) U.S. Cl.
CPC ..... *B08B 9/0933* (2013.01); *B08B 9/0808* (2013.01); *B65D 90/0093* (2013.01); *B05B 13/0405* (2013.01); *B05B 13/0636* (2013.01); *B05B 15/0406* (2013.01); *B05B 15/066* (2013.01); *B08B 9/0813* (2013.01)

(58) Field of Classification Search
CPC ..... B08B 3/02; B08B 3/025; B08B 9/0813; B08B 9/093; B08B 9/0933; B08B 9/0936; B08B 3/024; B08B 9/0808; B05B 3/12; B65D 90/0093
USPC ..... 134/167 R, 181; 239/227, 263.3, 239/264–265
See application file for complete search history.

(56) References Cited

U.S. PATENT DOCUMENTS 3,642,140 A 2/1972 Parker
3,688,506 A 9/1972 Marcocchio
(Continued)

FOREIGN PATENT DOCUMENTS

GB 2353230 A * 2/2001 ..... B01F 5/0218

OTHER PUBLICATIONS

"NES Tanksweep", published at www.tanksweep.com on or prior to Jul. 19, 2013 (available at http://web.archive.org/web/20130719095905/http://tanksweep.com/).*

*Primary Examiner* — Joseph L Perrin
*Assistant Examiner* — Kevin G Lee

(57) ABSTRACT

An apparatus and method for cleaning the interior of an above ground storage tank includes a nozzle assembly mounted to a cover on the storage tank sidewall having a horizontally extending wash pipe fixedly and a suction pipe for recirculation of spent fluids. The wash pipe has an interior segment which can be extended to a tank floor and is configured with a bend to extend along the tank sidewall to which is attached a submersible swivel joint fitted with a choked nozzle. The nozzle assembly is attached to a control assembly so that the direction of flow from the nozzle may be manipulated by rotation of the swivel joint from the exterior of the storage tank. The nozzle also may be adjusted so the direction of flow may follow the angle of the tank floor.

5 Claims, 9 Drawing Sheets

(51) Int. Cl.

| | |
|---|---|
| ***B65D 90/00*** | (2006.01) |
| *B05B 13/04* | (2006.01) |
| *B05B 13/06* | (2006.01) |
| *B05B 15/04* | (2006.01) |
| *B05B 15/06* | (2006.01) |

(56) References Cited

U.S. PATENT DOCUMENTS

| | | | | | |
|---|---|---|---|---|---|
| 3,690,463 | A | | 9/1972 | O'Brien | |
| 3,722,687 | A | | 3/1973 | Stebbins et al. | |
| 3,822,789 | A | | 7/1974 | Crisafulli | |
| 4,056,472 | A | | 11/1977 | Teasdale | |
| 4,827,563 | A | * | 5/1989 | Gordon | A47L 9/06 134/167 R |
| 5,085,242 | A | * | 2/1992 | Ripley | B08B 9/08 134/5 |
| 5,445,173 | A | * | 8/1995 | Aiken | B08B 9/0933 134/167 R |
| 5,458,414 | A | * | 10/1995 | Crump | B01F 3/1221 366/137 |
| 5,810,473 | A | * | 9/1998 | Manabe | B08B 9/0933 134/167 R |
| 6,285,919 | B1 | * | 9/2001 | Randolph | B08B 9/08 318/568.11 |
| 7,507,298 | B2 | * | 3/2009 | Falster-Hansen | B08B 9/08 134/166 R |
| 7,621,059 | B2 | * | 11/2009 | McCoy, Jr. | E02F 3/905 114/296 |
| 2004/0238009 | A1 | * | 12/2004 | Falster-Hansen | B08B 9/08 134/22.1 |
| 2011/0116869 | A1 | | 5/2011 | Crouse | |

* cited by examiner

METHOD AND APPARATUS FOR CLEANING THE INTERIOR OF AN ABOVE GROUND STORAGE TANK

PRIORITY

This is a continuation-in-part application under 37 CFR 1.53(b) entitled "Method and Apparatus for Cleaning the Interior of an above Ground Storage Tank". The pending prior application is Ser. No. 13/456,746 filed on Apr. 26, 2012 by applicant for "Method and Apparatus for Cleaning the interior of an above Ground Storage Tank", the entire contents of which are hereby incorporated by reference. This application claims priority to prior application Ser. No. 13/456,746.

FIELD OF INVENTION

This invention relates to the tank storage of crude oil and other volatile liquids. More particularly, the application relates to an apparatus for cleaning the interior of an above ground storage tank. The apparatus includes an articulating nozzle assembly that may be permanently attached to the sidewall of the storage tank.

BACKGROUND OF THE INVENTION

Crude oil refineries typically employ a bank or battery of above ground storage tanks that are used to hold liquids such as crude oil, heavy fuel oil, oil byproducts and the like. Contaminants, solid components, and heavier liquids that are suspended in the stored liquids will typically settle after time to the bottom of a storage tank. These contaminants, solid components, and heavier liquids will create sludge. This sludge can build up over time in an amount sufficient so as to reduce the tank capacity. The sludge buildup may also increase the risk of fire and explosion of retained liquids in the storage tank. Consequently, the sludge that is built up in the tanks comprising the storage tank battery must be periodically removed from the tank.

A number of mechanical devices are utilized for cleaning tanks without the necessity of having a worker enter the tank. Such devices employ nozzles that are positioned at the top or the sides of the tanks to be cleaned. These devices typically employ gimbal mounted nozzles with complicated nozzle guidance mechanisms. When positioned from the top, such devices cause high velocity fluid to be projected down against the tank floor which can cause wear on the tank integrity. When positioned from the sides, such devices fail to sufficiently clean the tank floor which typically has a slight downward slope towards its center. Further, while in use, typical devices have no way of removing spent fluid or the adherent sludge which has been removed. A need exists for a simple, user controlled cleaning device that may be deployed within the interior of an above ground storage tank.

Further, fixed nozzle tank cleaning devices may cause canyons to be formed in the adherent sludge on the tank floor wherein the fluid discharged from the nozzle will no longer remove the adherent sludge. As well, nozzles designed to be rotated within the tank can become locked up by sludge which has been disengaged from the tank floor wherein the nozzle will no loaner be allowed to rotate.

SUMMARY OF THE INVENTION

The present invention provides a simple, user controlled apparatus and method for deploying a cleaning nozzle within the interior of an above ground storage tank. The apparatus and method described includes an articulating nozzle assembly. The nozzle assembly may be adapted for permanent attachment in a manway cover attached in the vertically extending sidewall of the storage tank or for attachment into a separate hatch or port positioned in the vertically extending sidewall of the storage tank.

The articulating nozzle assembly may be comprised of a horizontally extending wash pipe and a horizontally extending suction pipe fixedly mounted to the vertically extending exterior sidewall of a storage tank. The wash pipe extends through the tank sidewall so that the wash pipe has an exterior portion extending from the storage tank sidewall on the outside of the storage tank and an interior portion extending from the storage tank sidewall on the inside of the storage tank. The exterior portion of the wash pipe has an exterior end configured for attachment to and fluid communication with a high pressure fluid source. The interior portion of the wash pipe is configured to have a desired bend so that wash pipe will generally extend along the vertically extending tank sidewall. The interior pipe may be vertically adjusted downward so that it will sweep just above the tank floor.

The section pipe extends through the tank sidewall so that the suction pipe has an exterior portion extending from the storage tank sidewall on the outside of the storage tank and an interior portion extending from the storage tank sidewall on the inside of the storage tank. The exterior portion of the suction pipe has an exterior end configured for attachment to and fluid communication with a high pressure vacuum source. The interior portion of the suction pipe may also be configured to have a desired bend so that suction pipe extends along the vertically extending tank sidewall. The interior portion of the suction pipe may be vertically adjusted downward so that it will sweep just above the tank floor.

The suction pipe may be used to apply a vacuum suction to clear around the tank sidewall, add cutter stock, or suction recirculating product from the tank to the fluid source and back through the nozzle. By suctioning the adherent sludge from around the nozzle assembly, the problem of articulating nozzles becoming locked in place by disengaged sludge is resolved.

A submersible swivel joint, such as a Chiksan® swivel, joint manufactured by FMC Technologies, Inc., is attached at the end of the interior portion of the wash pipe and the suction pipe to provide a fluid discharge end to the wash pipe that extends generally perpendicular to the vertically extending tank sidewall. The wash pipe discharge end of the wash pipe is fitted with a choked nozzle. In this configuration, the choked nozzle will rotate about the centerline of the wash pipe by means of the swivel joint. Similarly, the suction pipe suction end may be fitted with a suction nozzle or funnel to direct the material being vacuumed into the suction pipe.

The wash pipe and the suction pipe of the nozzle assembly may each be further provided with a control assembly so that the rotation of the choked nozzle about the centerline of the wash pipe and the suction funnel of the suction pipe can be manipulated from the exterior of the storage tank. The choked nozzle may also be offset at a small angle to follow the contour slope of the tank floor. The control assembly is generally comprised of a control bushing mounted in the sidewall of the storage tank at a position adjacent to the exterior portion of the wash pipe. The control bushing is fitted with a rotatable control shaft that has an exterior end extending generally perpendicular from the vertically extending sidewall of the storage tank and an interior end that extends into the interior of the storage tank. The interior end of the control shaft is fitted with a perpendicularly extending rod or bar fitted to a steering linkage. Exterior end of the control shaft is fitted with a crank or steeling wheel to facilitate rotation of the rotatable control shaft.

The control shaft with its associated steering linkage is utilized to rotatably control the position of the choked nozzle and suction funnel with respect to the swivel joint. The associated steering linkage can be any suitable linkage such as linkage associated with an eccentric gear drive, rack and pinion, cam, or wheel mechanisms.

DESCRIPTION OF EMBODIMENT

Figure 1:
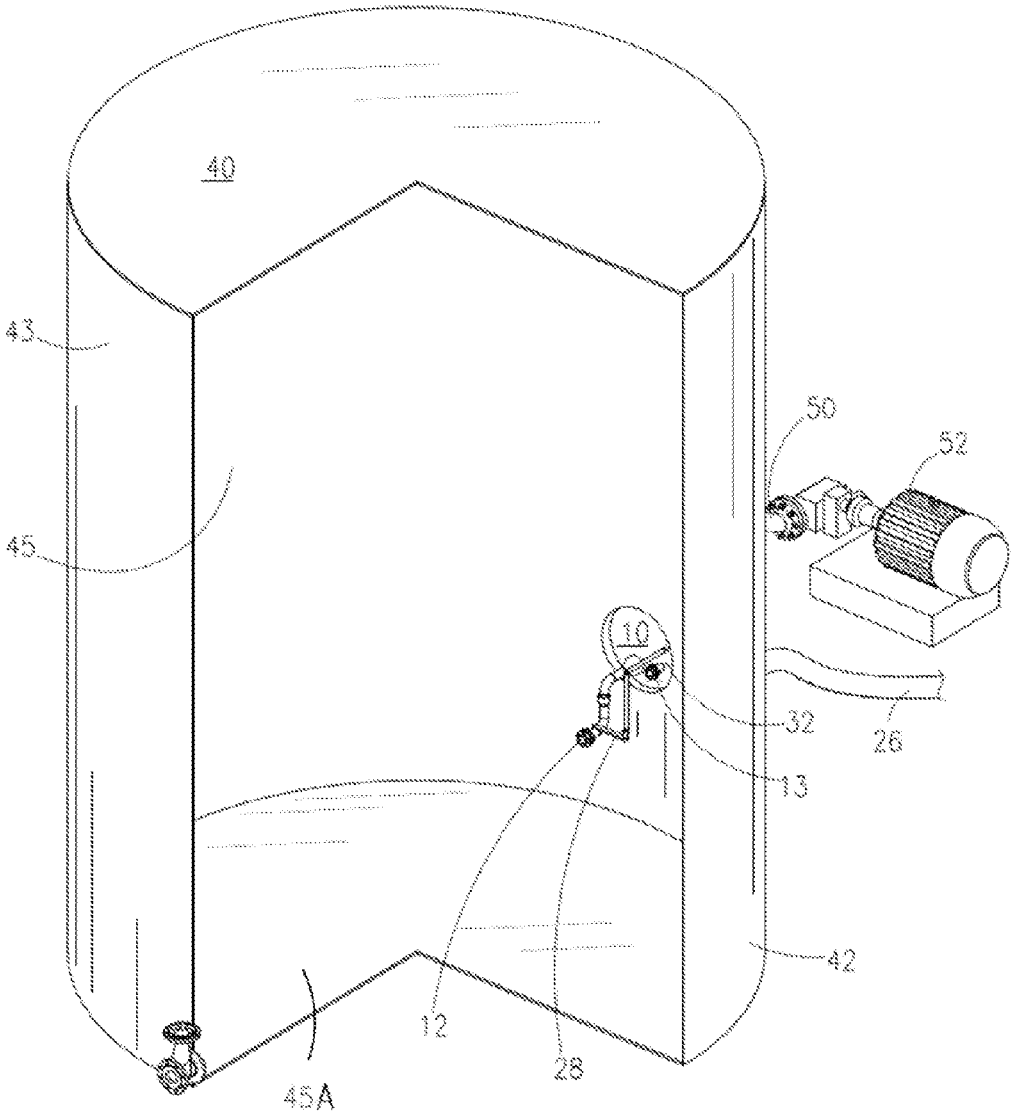
FIG. 1 is a cutaway perspective view of a storage tank fitted with the articulating nozzle assembly described herein.

FIG. 1 shows a cutaway perspective, view of an above ground storage tank (40) having a vertically extending sidewall (42) that separates the tank exterior (43) from the tank interior (45). The sidewall (42) of the storage tank (40) is fitted with one embodiment of an articulating nozzle assembly (10) comprised of a nozzle section (12), a suction section (13), and a nozzle steering or control section (14). The nozzle assembly (10) is used for cleaning the interior of the storage tank (40). The nozzle assembly (10) may be permanently or removably fitted on the storage tank (40) by attachment to a manway cover, hatch, or port (30) of an opening (32) in the sidewall (42) of the storage tank (40). The nozzle assembly (10) may also be permanently or removably fitted on the storage tank (40) by attaching it to a separate hatch, port cover, or other opening positioned in the vertically extending sidewall (42).

The nozzle section (12) of the assembly (10) is fitted to a high pressure fluid supply line (50) that is attached to a fluid supply, such as a water or crude oil supply, and pump system (52) so that wash fluid may be injected into the storage tank (40). The suction section (13) is attached to a vacuum system (54) which recirculates suctioned fluids to fluid supply and pump system (52).

Figure 2:
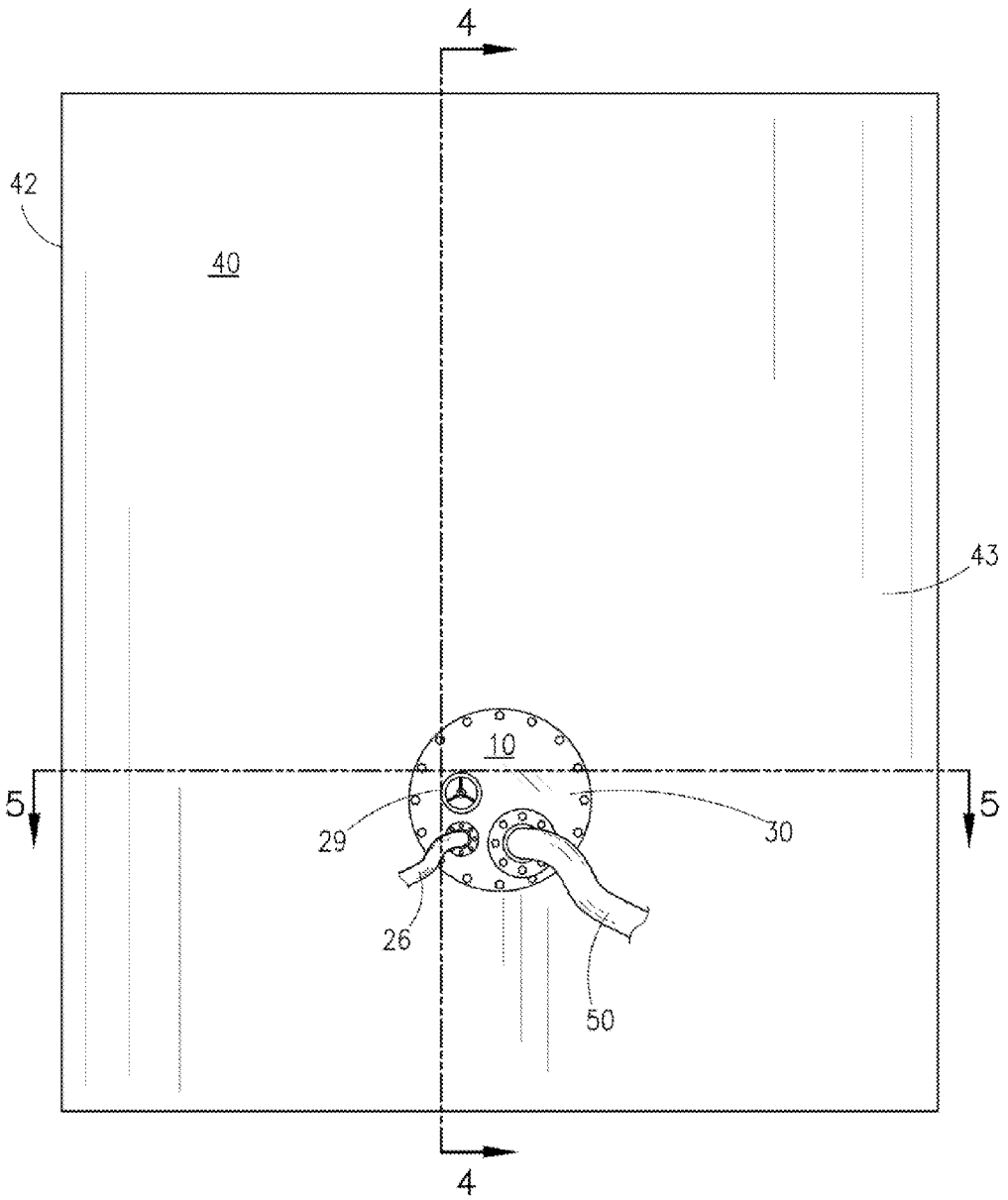
FIG. 2 is an outside elevation view of the above ground storage tank cleaning assembly shown in FIG. 1.
Figure 3:
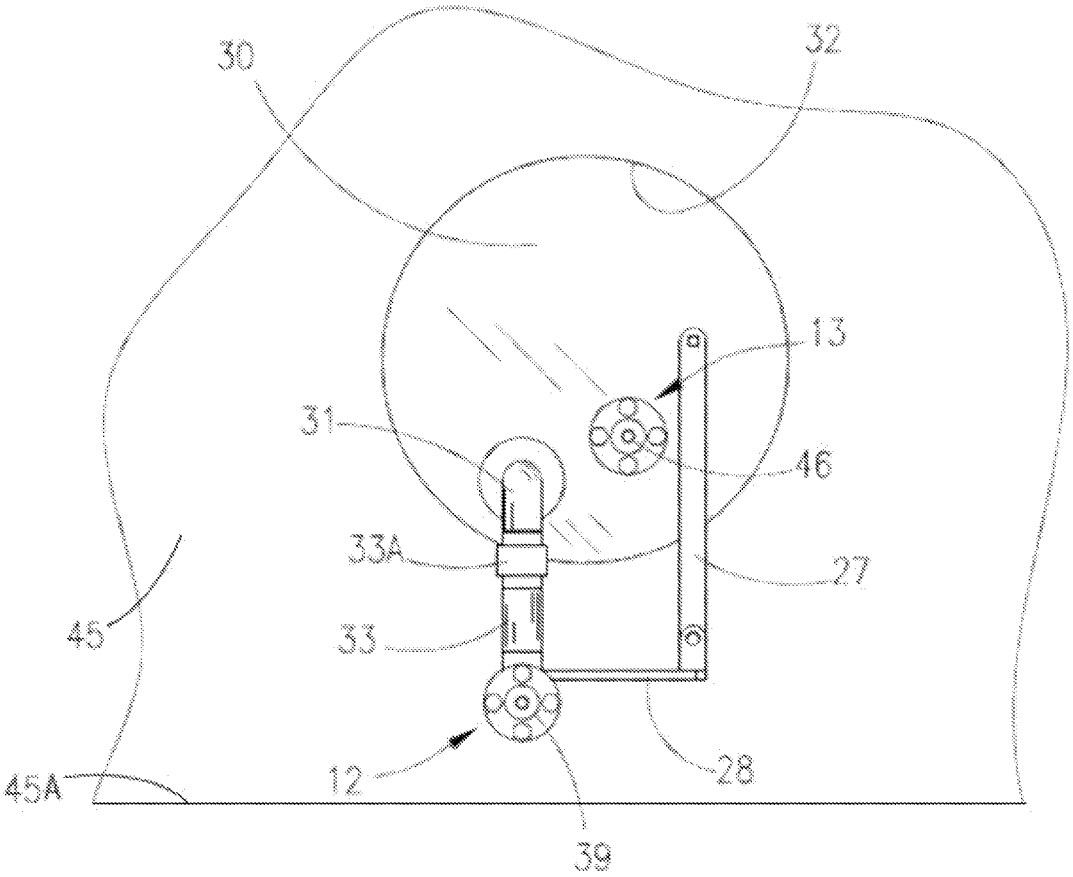
FIG. 3 is an interior elevation view of the above ground storage tank cleaning assembly shown in FIG. 1.

As shown in FIG. 2 and FIG. 3 the nozzle assembly (10) is fitted to the tank sidewall (42) where nozzle section (12) will be positioned adjacent tank floor (45A). However, the storage tank (40) may also be provided with a separate hatch, opening, or port, not shown, positioned in a desired location in the sidewall (42) where the apparatus (10) might also be attached.

Figure 4:
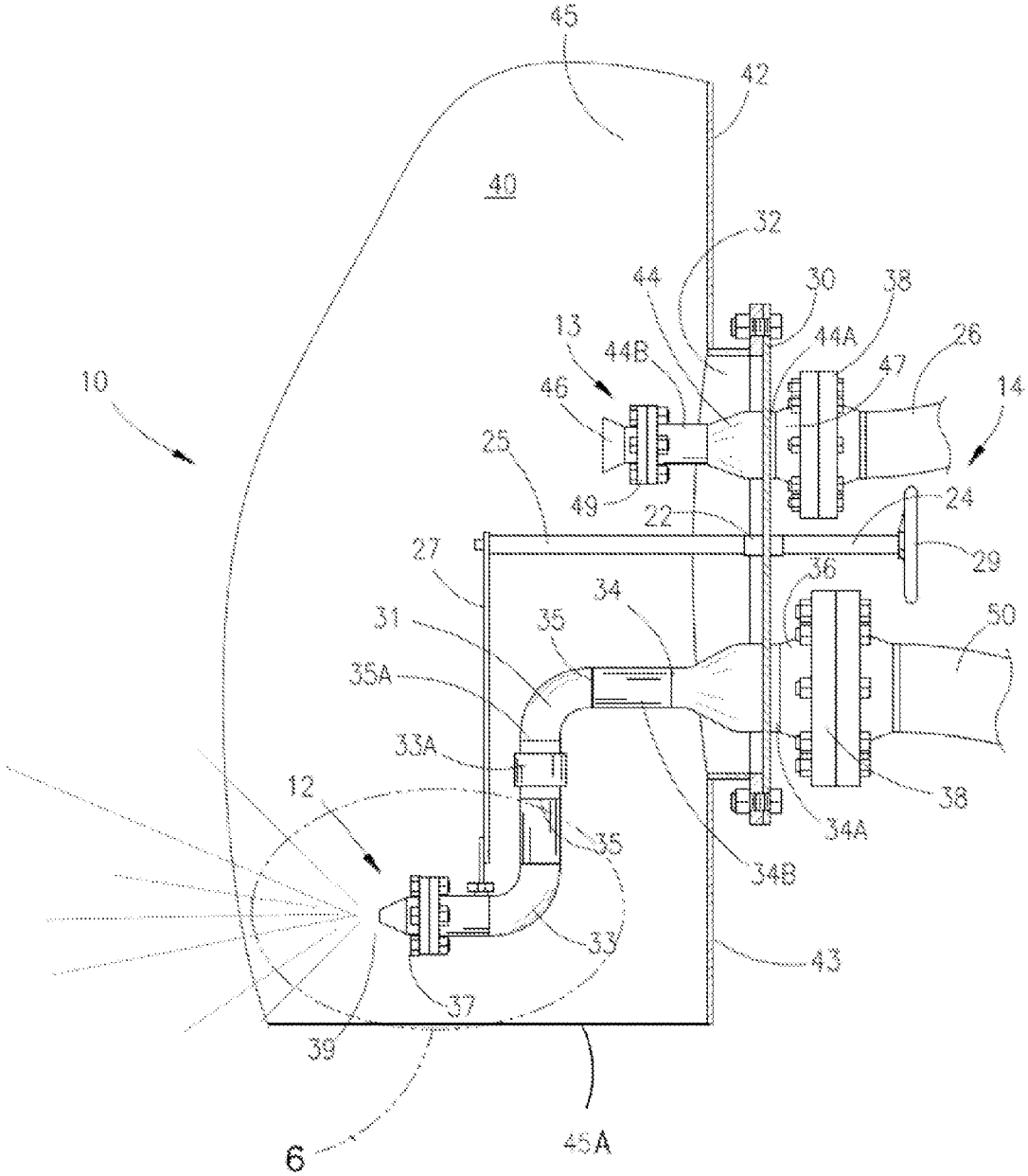
FIG. 4 is a side partial cross-section view of the above ground storage tank cleaning assembly shown in FIG. 1.

FIG. 4 shows a side partial cross-section view of the storage tank (40) with the tank sidewall fitted with the articulating nozzle assembly (10). In the interest of clarity, suction section (13) is shown at a position above nozzle assembly (12) though suction section (13) will be preferably positioned on the tank sidewall at a position in line with or below nozzle assembly (12) as needed in order to achieve adequate suction of fluids.

The nozzle section (12) of the nozzle assembly (10) is comprised of a horizontally extending wash pipe (34) that is fixedly mounted to the vertically extending sidewall (42) of the storage tank (40). The wash pipe (34) extends through the tank sidewall (42) so that the wash pipe (34) protrudes into the interior (45) of the storage tank (40) in a direction generally perpendicular to the tank sidewall (42) and has an exterior portion (34A) that extends away from the storage tank sidewall (42) on the tank exterior (43) of the storage tank (40) and an interior portion (34B) that extends from the storage tank sidewall (42) into the tank interior (45) of the storage tank (40).

The exterior portion (34A) of the wash pipe (34) has an exterior end (36) configured for attachment to and fluid communication with the high pressure fluid line (50) at the tank exterior (43) by means of an attachment flange (38) or other attachment means. The interior portion (34B) of the wash pipe (34) has an interior end (35) configured for attachment to and fluid communication with a pipe segment (31) in order to extend the interior portion (34B) of the wash pipe (34) along the vertically extending tank sidewall (42) in the tank interior (45).

Pipe segment (31) has a discharge end (35A) that is configured for attachment to the swivel end segment (33A) of a submersible joint (33), such as a Chiksan® swivel joint manufactured by FMC Technologies, Inc. The swivel joint (33) has a discharge end (37) that is fitted with a choked nozzle (39). In this configuration, the choked nozzle (39) will be rotatably positionable within the interior (45) of the tank (40) by means of the swivel joint (33). The wash pipe (34) can be adjusted, preferably by lengthening pipe segment (31), to allow the choked nozzle (39) of the nozzle section (12) to be extended adjacent to, and in use sweep slightly above, the tank floor (45A).

Figure 6A:
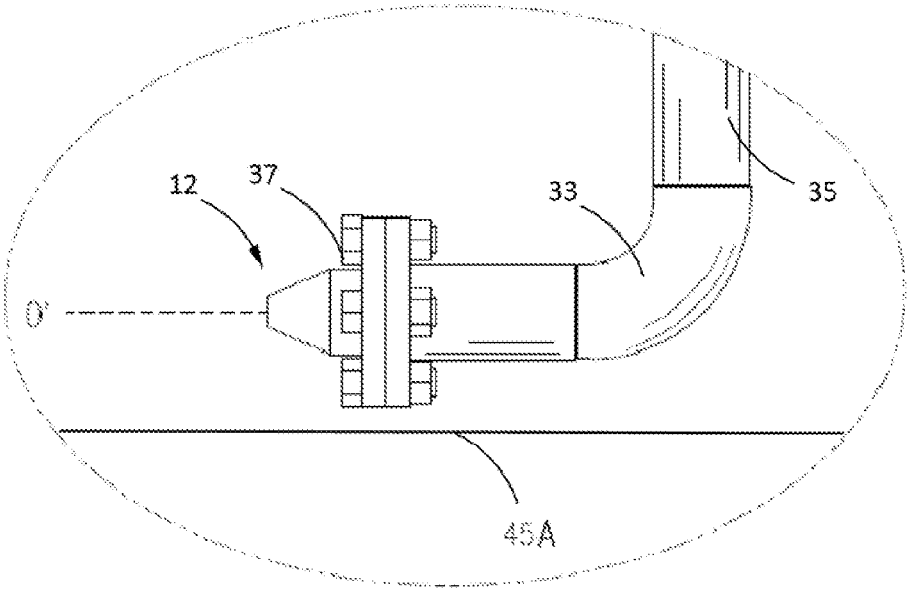
FIGS. 6A and 6B are a side partial cross-section view of the vertical articulation of the nozzle assembly shown in FIG. 1.
Figure 6B:
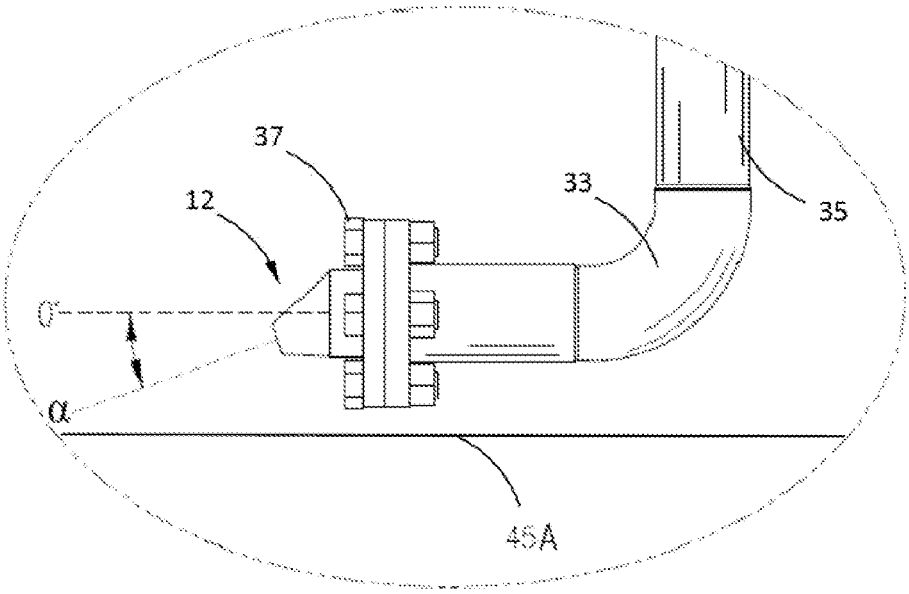

Highlighted area to shown in FIG. 4 refers to articulating nozzle (39) which is shown in FIGS. 6A and 6B. FIG. 6A shows nozzle (39) in a horizontal position and FIG. 6B depicts an alternate position of the articulating nozzle (39) offset at a desired downward angle ($\alpha$) to follow the downward sloped surface of the tank floor (45A). Offsetting, nozzle (39) at downward angle ($\alpha$) allows improved mixing at the floor, without creating potential for damaging the floor by directing fluid forces at a relatively perpendicular angle to the tank floor (45A) or at an angle where the fluid forces generated by the nozzle (39) will cause wear or damage to the floor surface. The angular adjustment of nozzle (39) in combination with the adjustment of interior end (35) to position the nozzle section (12) to sweep slightly above the tank floor (45A) will provide a means to clear adherent sludge, oil, or other petroleum slurry from the surface of the tank floor (45A) while improving the mixing at the tank floor (45A) without creating a potential for damaging the floor by projecting high velocity fluids against the tank surface.

The high velocity fluids projected by the nozzle section (12) may be any water, crude oil, or other fluid substance which may be directed in a jet or plume to dissolve and suspend accumulated sludge from a tank floor (45A).

The suction section (13) of the nozzle assembly (10) is comprised of a horizontally extending draw pipe (44) that is fixedly mounted to the vertically extending sidewall (42) of the storage tank (40). The draw pipe (44) extends through the tank sidewall (42) so that the draw pipe (44) protrudes into the interior (45) of the storage tank (40) in a direction generally perpendicular to the tank sidewall (42). The exterior portion (44A) of the draw pipe (44) extends away from the storage tank sidewall (42) on the tank exterior (43) of the storage tank (40) and the inter or portion (44B) of the draw pipe (44) extends from the storage tank sidewall (42) into the tank interior (45) of the storage tank (40).

The suction section (13) is attached to a collection hose or pipe, shown as disposed vacuum line (26), having a vacuum connection (26*a*) for connecting the vacuum line (26) to the vacuum system (54) for producing a vacuum force (Δ) at the suction section (13) to suction the adherent sludge (81) freed by nozzle section (12).

The exterior portion (44A) of the draw pipe (44) has an exterior end (47) configured for attachment to the vacuum line (26) at the tank exterior (43) by means of an attachment flange (38) or other attachment means. The interior portion (44B) of the draw pipe (44) has an intake end (49) that is fitted with a vacuum nozzle or funnel (46). In this configuration, the funnel (46) will be capable of clearing obstructions from around opening (32), can add cutter stock to the amalgam within the storage tank (40), or can be used to suction recirculating product from the tank (40) to water supply and pump system (52) in order to redistribute the recirculating product back through the nozzle (39) into the interior of the tank (40). Cutter stock may be any chemical or substance for aid in dissolving and breaking up of adherent fluid from the tank floor (45A).

Figure 5:
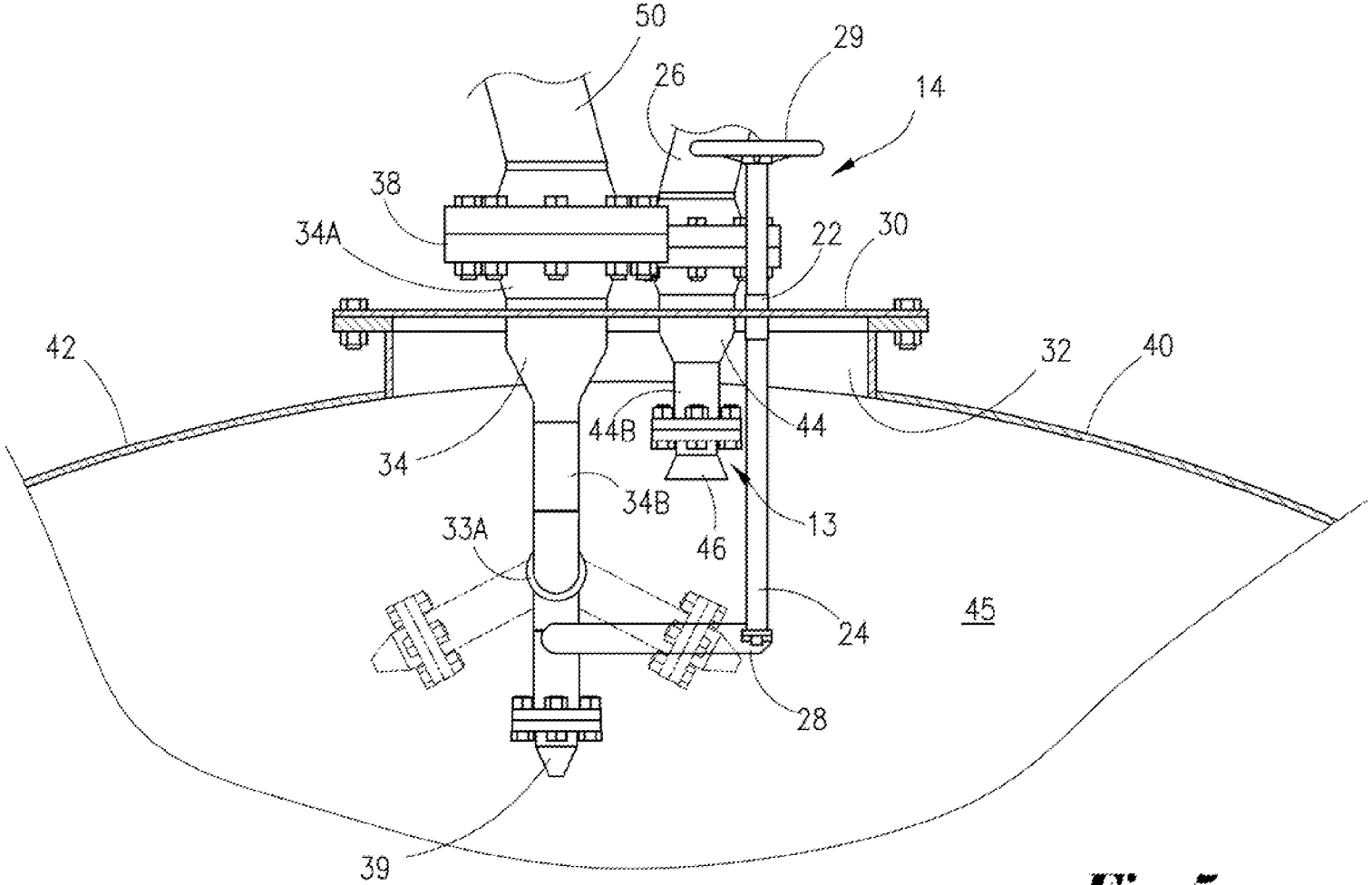
FIG. 5 is a top partial cross-section view of the above ground storage tank cleaning assembly shown in FIG. 1.

FIG. 3, FIG. 4, and FIG. 5 show the control section (14) of the nozzle assembly (10). Control section (14) is fitted to the nozzle section (12) so that the position of the choked nozzle (39) by means of the swivel section (34A) of the submersible joint (33) can be manipulated by a user from the exterior of the storage tank (42). The control assembly (14) is generally comprised of a rotatable control shaft (24) that has an exterior end (23) extending generally perpendicular from the vertically extending sidewall (42) of the storage tank (40) and an interior end (25) that extends into the interior (45) of the storage tank (40). The control shaft (24) is fitted through a control bushing (22) mounted on the tank sidewall (42) of the storage tank (40) at a position adjacent to the exterior portion (34A) of the wash pipe (34).

The interior portion (25) of the control shaft (24) has a perpendicularly extending control rod (27) pivotally fitted to a steering linkage (28) that is pivotally attached to the swivel joint (33). The exterior end (23) of the control shaft (24) is fitted with a steering wheel (29) to facilitate rotation of the rotatable control shaft (24). A handle projecting from the control shaft such as a crank, lever or other device for turning, the control shaft (24) may be utilized as a replacement for the steering wheel (29). When interior end (35) is adjusted to place nozzle section (12) adjacent the tank floor (45A), interior portion (25) of the control shaft (24) will be proportionately adjusted in order to articulate swivel joint (33).

As shown in FIG. 5, a top partial cross-section view of a storage tank fitted with the articulating nozzle assembly (10), rotation of the control shaft (24) of the nozzle assembly (12) will move the control rod (77) and by the associated steering linkage (28) control position of the choked nozzle (39) and thereby the direction of flow from the choked nozzle (39) as the swivel joint (33) pivots about the swivel segment (33A).

The control assembly (14) and associated steering linkage (28) can be any suitable steering mechanism such as an eccentric gear drive, rack and pinion, cam, or wheel mechanisms. An automated device or a powered turning mechanism may also be incorporated into the control assembly (14). For example, the control assembly (14) may be fitted with a motor, such as an electric or hydraulic motor, to rotate the control shaft (24) or to otherwise manipulate the steering linkage (28) as a substitute for the manual steering wheel (39).

Figure 7:
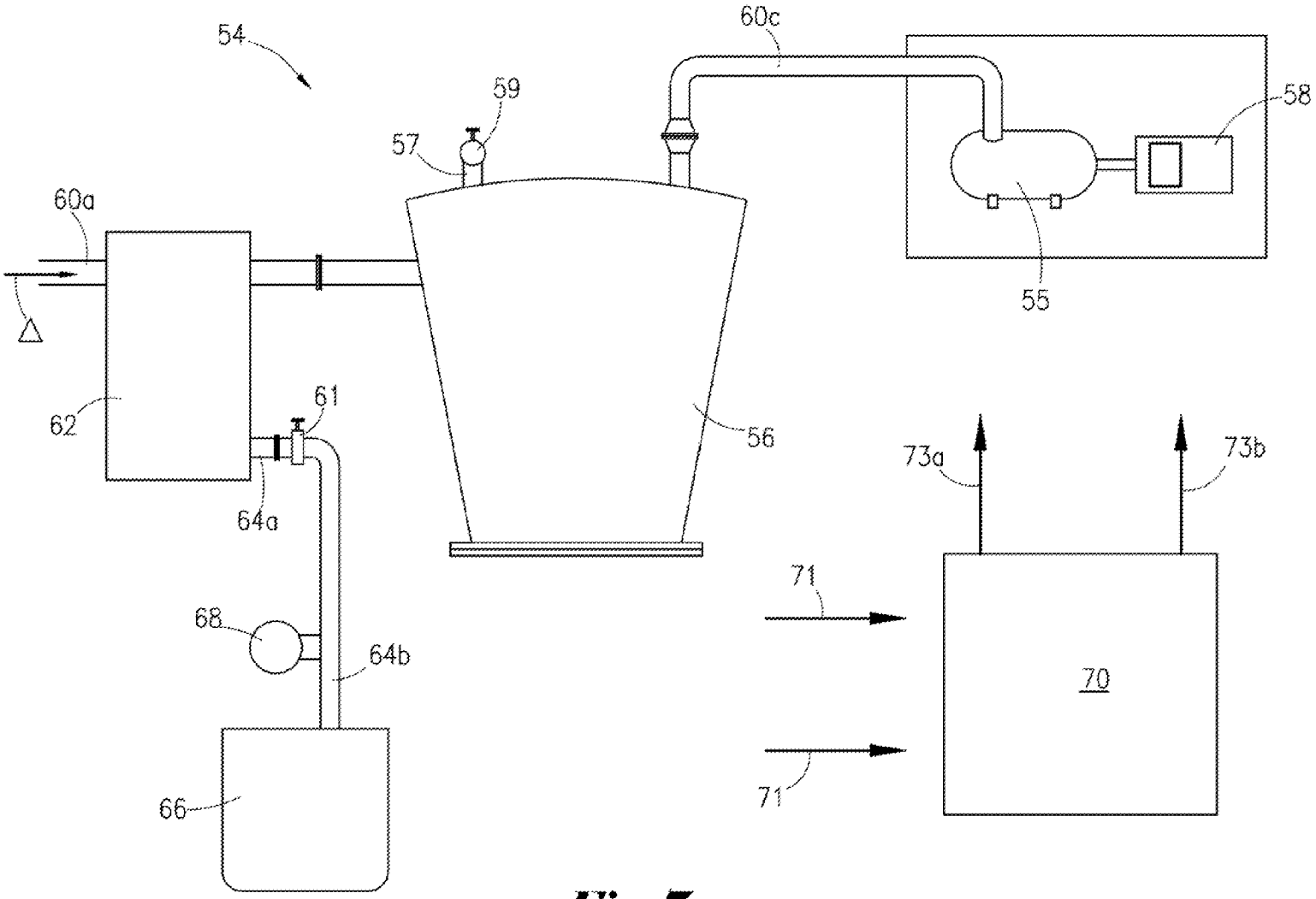
FIG. 7 is a schematic diagram of the vacuum system assembly of the above ground storage tank cleaning assembly shown in FIG. 1.
Figure 8:
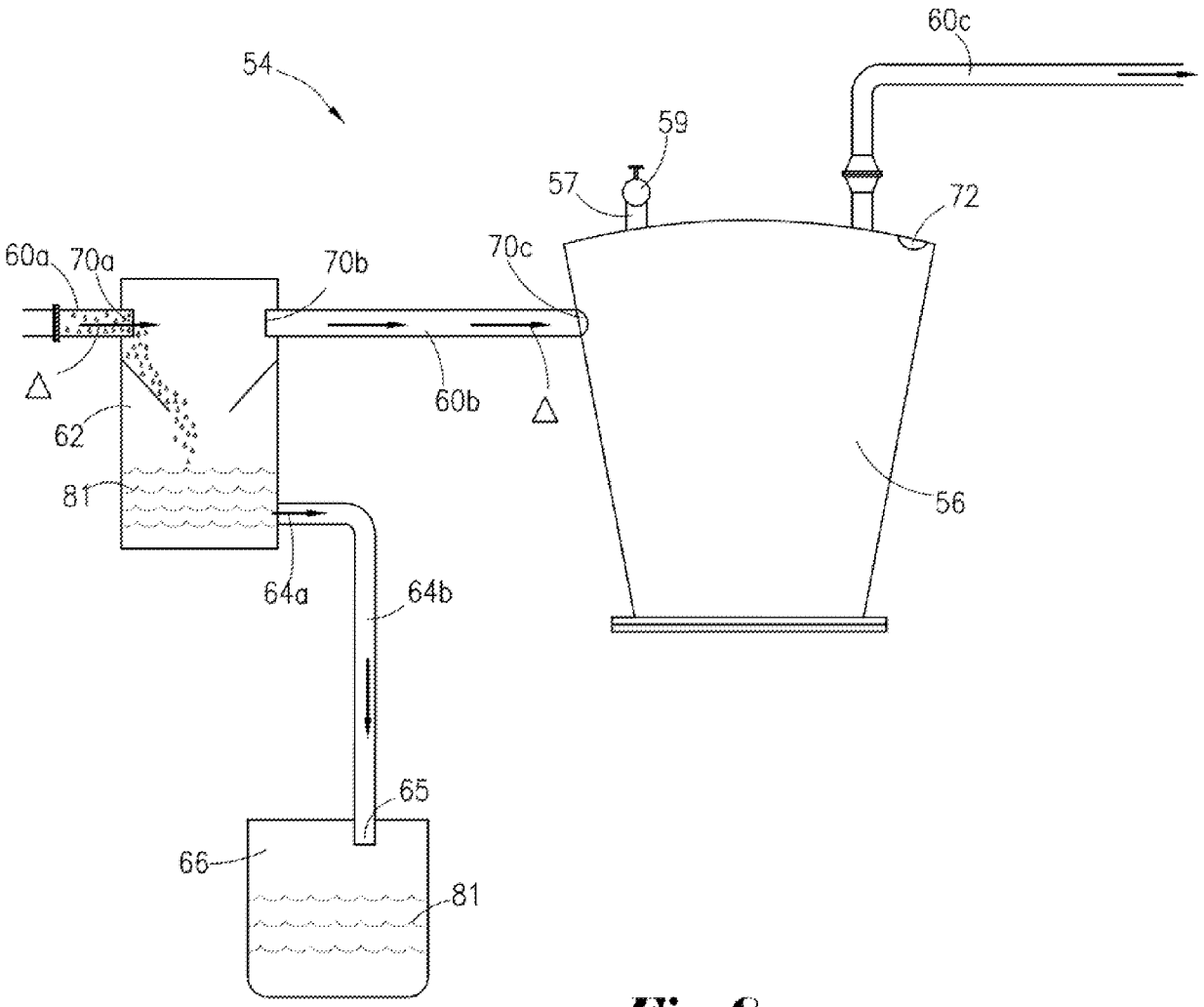
FIG. 8 is a schematic view of the vacuum assembly above ground storage tank cleaning assembly.

As shown in FIGS. 7 and 8, the vacuum system (54) is comprised of a motor (58) at vacuum pump (55) connected to a vacuum tank (56) by an associated vacuum line (60*c*). The vacuum tank (56) is connected at entry (70*c*) to a vacuum line (60*b*) that is connected at entry (70*b*) to a fluids collection chamber (62). The fluids collection chamber (62) is further connected at entry (70*a*) to a fluids vacuum line (60*a*). The fluids vacuum line (60*a*) is connected to the vacuum connection (58) of vacuum line (26) shown in FIG. 1. When activated the vacuum pump (55) will create a vacuum within vacuum tank (56) via vacuum line (60*c*), a vacuum within the fluids collection chamber (62) via vacuum line (60*b*), and provide a desired suction force (Δ) at the funnel (46) via fluid vacuum line (60*a*) which is in communication with vacuum line (26) by means of vacuum connection (26*a*). The suction force (Δ) at the funnel (46) will draw the freed adherent sludge (81) from the tank (40) into the fluids collection chamber (62).

The adherent sludge (81), drawn by suction through funnel (46) and vacuum line (26) into vacuum line (60*a*), is delivered through entry (70*a*) into the fluids collection chamber (62). The collected sludge (81), and any extraneous fluids drawn along with the sludge (81), will then spill into the fluids collection chamber (62) where it will be collected. The fluids collection chamber (62) is provided with an airtight fluids exit port (64*a*) having an associated fluids dump valve (61). The fluids exit port (64*a*) is in communication with a fluids discharge line (64*b*), discharge outlet (65) from the discharge line (64*b*) delivers fluids discharged from the fluids collection chamber (62) into a fluid holding tank (66) or to another desired location for ultimate disposal. A dump pump (68) may be provided with the discharge line (64*b*) to facilitate removal of the sludge (81) and any extraneous fluids from the fluids collection tank (62). The fluids dump valve (61) may be an automatic or manually operated valve such as a butterfly valve, a gate valve, or a ball valve.

The vacuum tank (56) may be provided with a vacuum control port (57) in communication with a vacuum control or relief valve (59). The vacuum relief valve (59) is used to regulate the suction created in the vacuum tank (56) and thus the suction created in the vacuum line (26) and ultimately the suction force (Δ) created at the funnel (46).

Pressure monitors (72) may be positioned at desired locations throughout the vacuum system (54) such as in the vacuum tank (56), the fluids collection chamber (62), or the vacuum line (26) to monitor and generate pressure signals (71). These pressure signals (71) may be delivered to a control panel (70) from which control signals (73*a*) may be generated and transmitted to the vacuum control valve (59) pump (55), or motor (58) as necessary to regulate the vacuum created in the vacuum tank (56) and the quantity of fluids delivered to the fluids collection chamber and to otherwise control the vacuum system (54). The control panel (70) may also be used to receive, generate, and transmit control signals (73*b*) to and from the fluids dump valve (61) at the fluids exit port (64*a*) of the fluids collection chamber (62) and to the dump pump (68) to regulate removal of the collected fluids from the fluids collection chamber (62).

A suction force (Δ) is then created at the funnel (46) by the vacuum system (54) and directed by the funnel (46) to suction the floating sludge (81), thereby clearing the area about the tank sidewall (42) of tank (40), drawing the floating sludge (81) into the fluids collection chamber (62) of the vacuum system (54).

The vacuum system (54) is assembled with motor (55) connected to the vacuum pump (58), vacuum pump (58) connected to vacuum tank (56) via vacuum line (60*c*), fluids collection tank (62) connected to vacuum tank (56) via vacuum line (60*b*), and vacuum line (26) connected to fluids collection tank (62) is fluids vacuum line (60*a*).

With the vacuum system (54) attached to the vacuum line (26) of the suction section (13), the motor (55) and vacuum pump (58) is then activated to create a vacuum in vacuum tank (56). Creating a vacuum in the vacuum tank (56) will create a vacuum in the fluids collection tank (62), a suction force (Δ) in fluid vacuum line (60*a*) and in vacuum line 26), and a suction force (Δ) at the funnel (46) whereby the sludge (81) will be drawn through funnel (46), vacuum line (26), and fluid vacuum line (60*a*) into fluids collection chamber (62) where the suctioned sludge (81) will be collected.

Controlling the suction force (Δ) and the flow of sludge (81) into and out of the fluids collection chamber (62) may be accomplished by manually controlling the vacuum relief valve, the dump valve (61), the dump pump (68), the motor (55), and the vacuum pump (58). Controlling the suction force (Δ) and the flow of sludge (81) into and out of the fluids collection chamber (62) may also be accomplished by automatically controlling, the vacuum relief valve, the dump valve (61), the dump pump (68), the motor (55), and the vacuum pump (58) by providing a generating control signals (71 and 73*a*, 73*b*) to and from the control panel (70) and the associated valves, pumps, and motors.

Further, the funnel (46) will be capable of adding cutter stock to the amalgam within the storage tank (40) by providing cutter stock to vacuum line (26) and causing a positive pressure to be applied to the vacuum line (26). After addition of cutter stock to tank (40), typical washing procedures through nozzle assembly (12) may proceed after which funnel (46) may then be used to suction recirculating product and cutter stock from tank (40) to fluid holding tank (66) wherein recirculating product may be filtered from the sludge (81) and cutter stock and reintroduced into water supply and pump system (52) in order to redistribute the recirculating product back through the nozzle (39) into the interior of the tank (40).

In use, the nozzle assembly (12) and suction pipe (13) of the apparatus (10) are permanently or removably mounted to the vertically extending sidewall (42) of the storage tank (40) containing adherent sludge (81). The wash pipe (34) and draw pipe (44) extend through the tank sidewall (42) of tank (40) with the exterior portions (34A) of the wash pipe (34) and (44A) of the draw pipe (44) on the exterior (43) of the storage tank (40) and an interior portions (34B) of the wash pipe (34) and (44A) of the draw pipe (44) extend into the tank interior (45) of the storage tank (40). The swivel segment (33A) of the submersible swivel joint (33) is then attached to the end (35) of the interior portion (34B) of the wash pipe (34) and the discharge end (37) of the swivel joint (33) is fitted with a choked nozzle (39). The nozzle assembly (12) is then positioned adjacent to the floor (45A) of tank (40). The steering linkage (28) of the control assembly (14) is then attached to the swivel joint (33) in a configuration that will allow rotation of the choked nozzle (39) about the centerline of the interior wash pipe (34B) by means of the swivel joint (33) when the steering wheel (29) is turned to rotate the control shaft (24).

Flow from the choked nozzle (39) is accomplished by attachment of exterior portion (34A) of the wash pipe (34) to the thud line (50) at the tank exterior (43) by means of the attachment flange (38) or other attachment means. The swivel joint (33) with the attached control shaft (24) by means of the associated steering linkage (28) will then allow the nozzle (39), and any associated flow, to be directed to a desired position and location in the interior (45) of the storage tank (40) by rotation and manipulation of the control shaft (24) and associated steering linkage (28).

During the process of flow from choked nozzle (39) or after a sufficient flow has been achieved, fluid may be reclaimed through funnel (46) by activating vacuum system (54) which will draw fluid into funnel (46), through draw pipe (44), and into fluid source (52) where the fluid may then be recirculated to clean storage tank (40).

Figure 9:
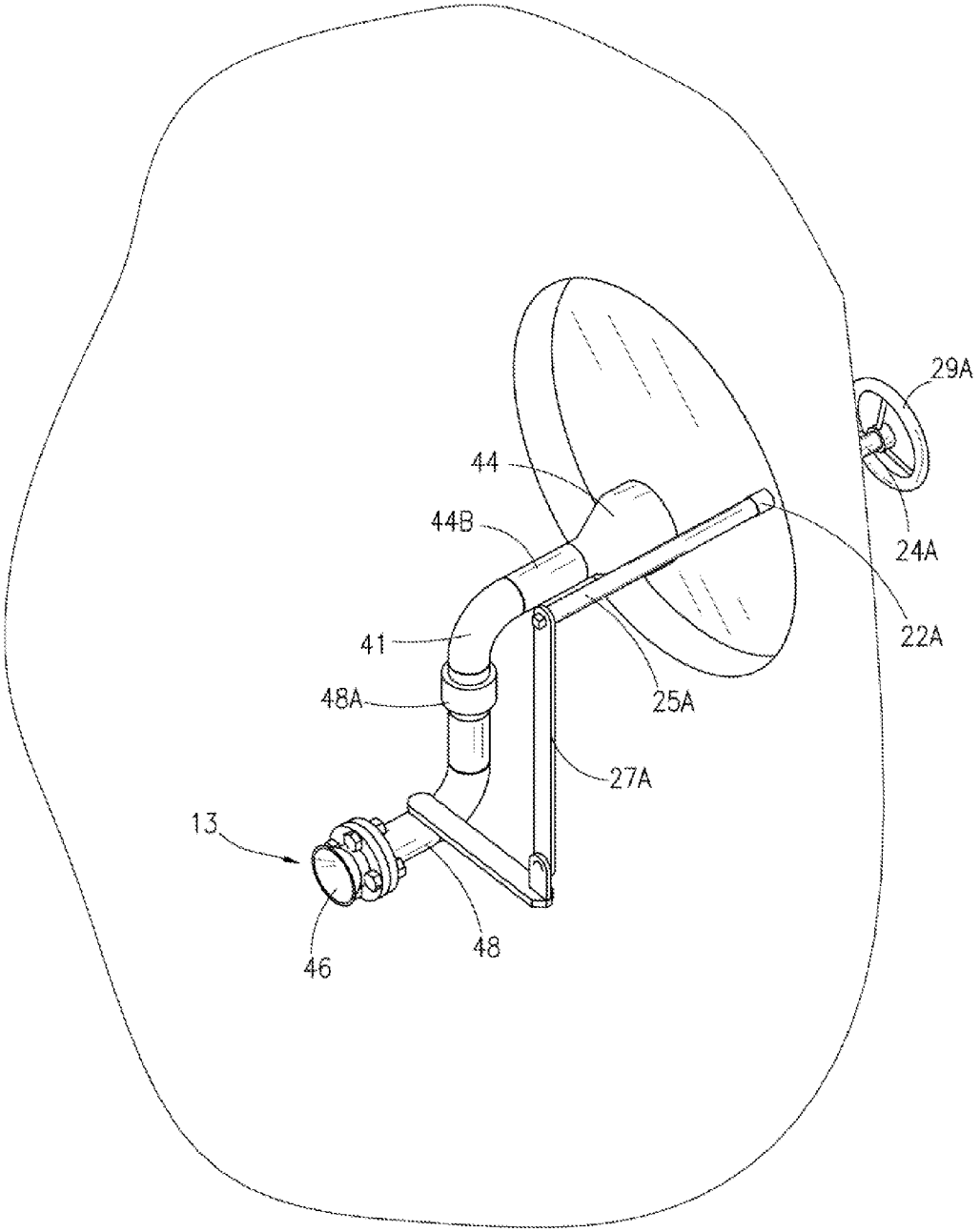
FIG. 9 is an isometric view of the suction section of the above ground storage tank cleaning assembly being articulable above the tank floor of an above ground storage tank.

FIG. 9 depicts an isometric view of suction section (13) wherein nozzle section (12) has been omitted to best show the function of the suction section (13) being articulable. As shown in FIG. 9, suction section (13) may be configured in the same manner as nozzle section (12) shown in FIGS. 3, 4, 5, 6A and 6B. In such a configuration suction section (13) will be provided with ninety degree pipe segments (41 & 48), a steering linkage (28A), control rod (27A), and a swivel joint (48) so as to allow funnel (46) to be positioned adjacent tank floor (45A) and articulated and positioned as desired, as described for nozzle section (12), to allow suction force (α) to draw in adherent sludge.

It is thought that the proposed apparatus and method for cleaning, the interior of an above ground storage tank presented herein and many of its attendant advantages will be understood from the foregoing description. It is also thought that it will be apparent that various changes may be made in the form, construction and arrangement of the parts and steps of the apparatus and method without departing from the spirit and scope of the invention or sacrificing all of its material advantages.

We claim:

1. In a storage tank having a vertically extending sidewall that separates the tank exterior from the tank interior, a nozzle assembly comprising:

(a) a nozzle section, said nozzle section having a horizontally extending wash pipe fixedly mounted to the vertically extending sidewall of a storage tank, said wash pipe having a section exterior to said tank sidewall and a section interior to said sidewall, said interior section of said nozzle section extending adjacent to the tank floor of said storage tank;

(b) a suction section, said suction section having a horizontally extending draw pipe fixedly mounted to said vertically extending sidewall of said storage tank, said draw pipe having a section exterior to said tank sidewall and a section interior to said sidewall;

(c) a first wash pipe segment attached to said interior section of said wash pipe of said nozzle section;

(d) a second wash pipe segment attached to said first wash pipe segment of said nozzle section, said second wash pipe section having a submersible swivel joint;

(e) a nozzle attached to said second wash pipe segment, said nozzle being adjustable to direct fluid to follow the downward sloped surface of said tank floor;

(f) a funnel attached to said interior section of said draw pipe;

(g) a high pressure fluid supply line fitted to said exterior section of said wash pipe;

(h) a fluid pump system connected to said fluid supply line;

(i) a vacuum line fitted to said exterior section of said draw pipe;

(j) a vacuum system connected to said vacuum line;

(k) a control assembly attached to said nozzle section whereby the position of said nozzle may be rotatably manipulated about said swivel joint from said exterior of said storage tank;

(l) control shaft fitted through a bushing mounted in said tank sidewall;

(m) a control rod pivotally attached to said control shaft;

(n) steering linkage pivotally attached to said control rod and said second wash pipe segment;

(o) means for turning said control shaft and thereby manipulating said control rod and said steering linkage whereby said second wash pipe segment will rotate about said swivel joint; and (p) wherein said interior section of said suction section being adjustable to extend adjacent to the tank floor of a storage tank comprising a first draw pipe segment in communication with said interior section of said wash pipe of said suction section and a second draw pipe segment in communication with said first draw pipe segment of said suction section, said second draw pipe segment having a submersible draw pipe swivel joint.

2. The nozzle assembly as recited in claim 1, further comprising said control assembly attached to said suction section whereby the position of said funnel may be rotatably manipulated about said draw pipe swivel joint from said exterior of said storage tank.

3. The nozzle assembly as recited in claim 2, wherein said means for turning said control shaft and thereby manipulating said control rod is a steering wheel.

4. The nozzle assembly as recited in claim 2, wherein said means for turning said control shaft and thereby manipulating said control rod is a handle projecting from said control shaft.

5. The nozzle assembly as recited in claim 2, wherein said means for turning said control shaft and thereby manipulating said control rod is a motor.

* * * * *